US010760150B2

(12) United States Patent
Majka

(10) Patent No.: US 10,760,150 B2
(45) Date of Patent: Sep. 1, 2020

(54) MARTENSITIC ALLOY COMPONENT AND PROCESS OF FORMING A MARTENSITIC ALLOY COMPONENT

(71) Applicant: General Electric Company, Schenectady, NY (US)

(72) Inventor: Theodore Francis Majka, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 246 days.

(21) Appl. No.: 15/933,543

(22) Filed: Mar. 23, 2018

(65) Prior Publication Data

US 2019/0292638 A1 Sep. 26, 2019

(51) Int. Cl.

| | |
|---|---|
| ***C21D 6/02*** | (2006.01) |
| ***C22C 38/38*** | (2006.01) |
| ***C22C 38/02*** | (2006.01) |
| ***C22C 38/22*** | (2006.01) |
| ***C22C 38/24*** | (2006.01) |
| ***C22C 38/04*** | (2006.01) |
| ***C21D 9/38*** | (2006.01) |
| *C21D 6/00* | (2006.01) |

(52) U.S. Cl.

CPC ..... *C22C 38/38* (2013.01); *C21D 9/38* (2013.01); *C22C 38/02* (2013.01); *C22C 38/04* (2013.01); *C22C 38/22* (2013.01); *C22C 38/24* (2013.01); *C21D 6/002* (2013.01); *C21D 6/005* (2013.01); *C21D 6/008* (2013.01); *C21D 2211/008* (2013.01)

(58) Field of Classification Search

CPC .. C21D 2211/008; C21D 6/002; C21D 6/005; C21D 9/38; C22C 38/04; C22C 38/22; C22C 38/24; C22C 38/38

USPC ..... 148/334

See application file for complete search history.

(56) References Cited

U.S. PATENT DOCUMENTS 4,895,700 A * 1/1990 Davison ..... C21D 8/06 148/320
5,374,322 A * 12/1994 Okada ..... C21D 8/0263 148/663

(Continued)

FOREIGN PATENT DOCUMENTS

EP 2218799 A1 8/2010
EP 2246456 A1 11/2010

(Continued)

OTHER PUBLICATIONS

International Search Report issued in connection with corresponding EP application No. 19164686.8 dated Jun. 7, 2019, 17 pages.

(Continued)

*Primary Examiner* — Jie Yang

(74) *Attorney, Agent, or Firm* — James Pemrick; Hoffman Warnick LLC

(57) ABSTRACT

A martensitic alloy component includes by weight, 0.25% to 0.31% carbon (C), 2.1% to 3.0% manganese (Mn), 0.22% to 0.28% silicon (Si), 2.0% to 2.2% chromium (Cr), 0.45% to 0.55% molybdenum (Mo), 0.08% to 0.12% vanadium (V), and the balance is iron (Fe) and incidental impurities. The manganese-chromium martensitic alloy component has a hardenability corresponding to an ideal diameter of about 15 inches to about 30 inches or more.

20 Claims, 1 Drawing Sheet

(56) References Cited

U.S. PATENT DOCUMENTS

| | | | | |
|---|---|---|---|---|
| 5,645,794 | A | 7/1997 | Beguinot | |
| 5,922,145 | A | 7/1999 | Watari | |
| 6,602,359 | B1 | 8/2003 | Ochi | |
| 2005/0115644 | A1 | 6/2005 | Beguinot | |
| 2014/0345756 | A1* | 11/2014 | Ridge | C22C 38/04 148/598 |

FOREIGN PATENT DOCUMENTS

| | | | |
|---|---|---|---|
| EP | 2383359 | A1 | 11/2011 |
| FR | 2838137 | A1 | 10/2003 |
| JP | H0336234 | A | 2/1991 |
| JP | H09111405 | A | 4/1997 |
| JP | H11236642 | A | 8/1999 |
| JP | 2973909 | B2 | 11/1999 |
| JP | 2001234277 | A | 8/2001 |
| JP | 2001262274 | A | 9/2001 |
| JP | 3267124 | B2 | 3/2002 |
| JP | 2010065294 | A | 3/2010 |

OTHER PUBLICATIONS

Leica mettallurgy Application Briefing, Application Solutions for metallurgy, Cambridge, UK, 2000, pp. 1-127.

* cited by examiner

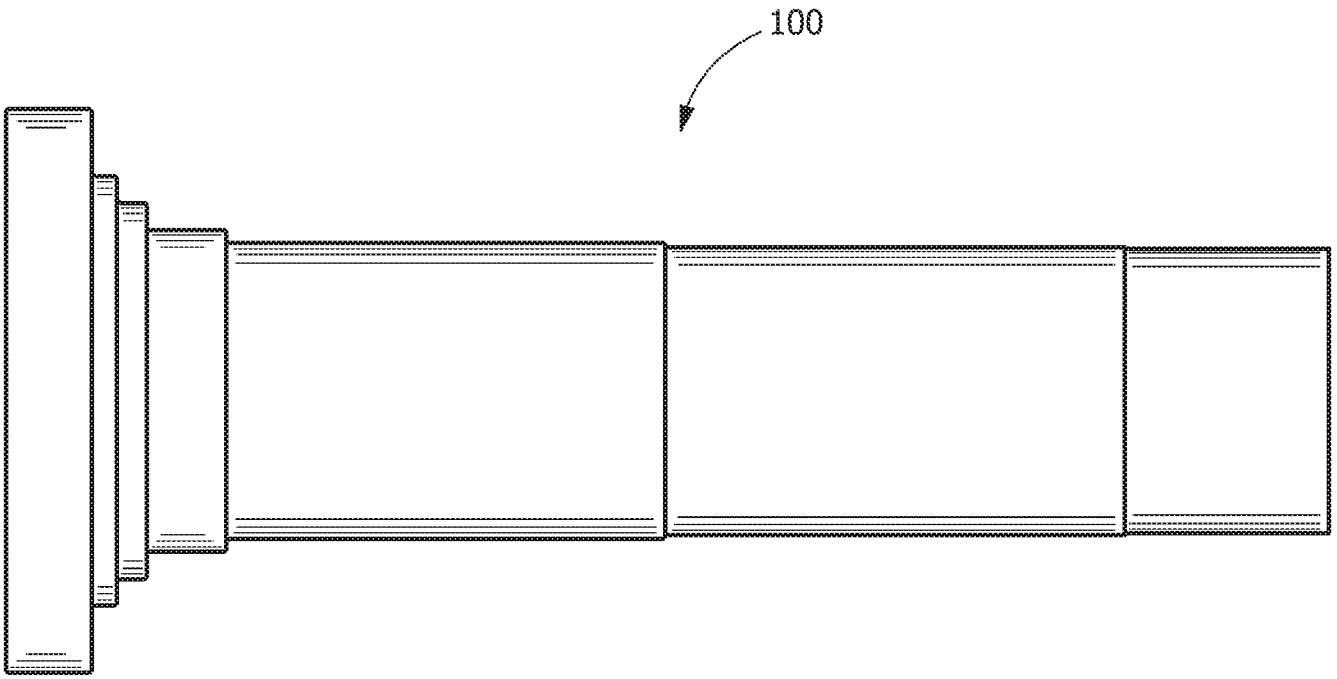
100

MARTENSITIC ALLOY COMPONENT AND PROCESS OF FORMING A MARTENSITIC ALLOY COMPONENT

FIELD OF THE INVENTION

The present invention is directed to martensitic alloys, articles including martensitic alloys, and processes of forming alloys. More specifically, the present invention is directed to a manganese-chromium martensitic alloy and a process of forming a manganese-chromium martensitic alloy.

BACKGROUND OF THE INVENTION

Turbomachines are exposed to significant operational stresses from heat and rotational forces. As turbomachines increase their outputs, the size and required properties of the turbomachine's rotor shaft increase. Forged/hardened steel (e.g., a NiCrMoV alloy) is the material of choice for rotor shafts, and rotor shafts are typically machined out of a steel forging. The material of the rotor shaft is usually quenched-tempered high-strength low-alloy steel with critical fatigue properties. The NiCrMoV alloy currently used for these rotor shafts employ nickel, chromium, and molybdenum to provide a desirable hardenability of the alloy. Although NiCrMoV has performed well in smaller rotor shafts, it does not provide desired hardenability and fracture appearance transition temperature (FATT) in larger rotor shafts. With the trend toward larger gas turbines and bigger compressor rotor components such as wheels and forward stub shafts, the current materials such as NiCrMoV steel are falling short of the desired properties, in particular deep-seated impact toughness properties. The large cross-sections of these parts make it challenging for manufacturers to meet the FATT requirements, particularly in deep seated locations where the cooling rate is the slowest during quench and temper heat treatment processes.

BRIEF DESCRIPTION OF THE INVENTION

In one aspect, a martensitic alloy component includes by weight:

0.25% to 0.31% C;
2.1% to 3.0% Mn;
0.22% to 0.28% Si;
2.0% to 2.2% Cr;
0.45% to 0.55% Mo;
0.08% to 0.12% V; and
balance iron and incidental impurities; and
wherein the component has a hardenability corresponding to an ideal diameter of about 15 inches to about 30 inches or more.

In another aspect, a turbomachine shaft is comprised of a martensitic alloy, and the martensitic alloy includes by weight:

0.25% to 0.31% C;
2.1% to 3.0% Mn;
0.22% to 0.28% Si;
2.0% to 2.2% Cr;
0.45% to 0.55% Mo;
0.08% to 0.12% V; and
balance iron and incidental impurities; and
wherein the martensitic alloy has a hardenability corresponding to an ideal diameter of about 20 inches to about 30 inches or more.

In yet another aspect, a process of forming a manganese-chromium martensitic alloy component includes forging the alloy component including by weight:

0.25% to 0.31% C;
2.1% to 3.0% Mn;
0.22% to 0.28% Si;
2.0% to 2.2% Cr;
0.45% to 0.55% Mo;
0.08% to 0.12% V;
balance iron and incidental impurities;
austenitizing the forged alloy;
quenching the austenitized alloy;
tempering the quenched alloy; and
wherein the component has a hardenability corresponding to an ideal diameter of 20 inches to 30 inches or more.

After forging, the manganese-chromium martensitic alloy component is austenitized, quenched and tempered. The tempered forged alloy has a hardenability corresponding to an ideal diameter of about 20 inches to about 30 inches or more.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Provided is an exemplary manganese-chromium alloy component having predetermined properties and a process of forming the manganese-chromium alloy component having predetermined properties. Aspects of the present disclosure, in comparison to methods and products not utilizing one or more features disclosed herein, decrease or eliminate nickel percentage, increase chromium percentage, increase manganese percentage, decrease material cost, increase martensite percentage, lower and improve fracture appearance transition temperature (FATT), and increase the ideal diameter (Di), or a combination thereof.

In one aspect, the disclosure includes a process for producing a turbomachine shaft (e.g., a turbine rotor shaft or a compressor rotor shaft) from a martensitic alloy. The process may also be used for producing the main shaft for a wind turbine from a martensitic alloy, though it should be understood that the invention is also well suited for the production of a wide variety of components from martensitic alloy compositions. Other non-limiting examples include automotive components, such as dynamoelectric machine shafts, axles, and various other components used in the energy, automotive, railroad, construction, mining and agricultural industries. Such components are well known in the art and therefore require no further description.

With reference to FIG. 1, the shaft 100 is represented as having a generally cylindrical shape with an optional flange formed at one end, though it can be appreciated that FIG. 1 is merely a schematic representation and different configurations for the shaft 100 are also within the scope of the invention. Although the shaft 100 shown in FIG. 1 includes a plurality of segments, the shaft 100 may also be formed of a unitary piece. The shaft 100 may be solid or hollow or a combination of solid and hollow components. The shaft 100 has an axisymmetric geometry with respect to the longitudinal axis of rotation of the shaft 100. Shaft 100 may be used in a wind turbine or turbomachine, and the shaft 100 may have an outer diameter well in excess of 20 inches (about 50 cm), and more typically in excess of 24 inches (about 60 cm), with a typical range being about 25 to 60 inches (about 63 to about 152 cm), though lesser and greater diameters are also foreseeable. Other aspects of the shaft 100, including its installation in turbomachines or wind turbines and the operation thereof, are otherwise known in the art, and therefore will not be discussed here in any detail.

The martensitic alloy, according to the present disclosure, includes the composition shown in Table 1.

TABLE 1

| wt % | First Range | Alternate Range 1 | Alternate Range 2 | Alternate Range 3 | Alternate Range 4 |
|---|---|---|---|---|---|
| C | 0.25-0.31 | 0.23-0.32 | 0.20-0.35 | 0.25-0.31 | 0.25-0.31 |
| Mn | 2.1-3.0 | 2.2-3.0 | 2.3-3.0 | 2.4-3.0 | 2.5-3.0 |
| Si | 0.22-0.28 | 0.20-0.30 | 0.18-0.35 | 0.22-0.28 | 0.22-0.28 |
| Cr | 2.0-2.2 | 2.01-2.25 | 2.1-2.3 | 2.0-2.2 | 2.0-2.2 |
| Mo | 0.45-0.55 | 0.40-0.60 | 0.35-0.65 | 0.45-0.55 | 0.45-0.55 |
| V | 0.08-0.12 | 0.07-0.13 | 0.06-0.14 | 0.08-0.12 | 0.08-0.12 |
| Ni | 0-trace | 0-trace | 0-trace | 0-trace | 0-trace |
| Fe | Bal | Bal | Bal | Bal | Bal |

A component formed from the composition, according to the present disclosure, includes a hardenability corresponding to an ideal diameter (a) of 20 inches (50.8 cm) to 30 inches (76.2 cm) or more. In one embodiment, the component has a hardenability corresponding to an ideal diameter of about 30 inches (76.2 cm). In another embodiment, the component has a hardenability corresponding to an ideal diameter up to about 40 inches (101.6 cm) or more. Hardenability corresponding to an ideal diameter, as utilized herein, is the ability of material, component, and heat treatment (e.g., after an ideal quench from an austenitizing temperature), to form at least 50% martensite at the center of a solid cylinder. While the above definition of hardenability corresponding to an ideal diameter is based from a solid component, one of ordinary skill in the art would understand that the geometry is not limited to a solid cylinder and may include other geometries and/or hollow components. For example, the hardenability of hollow components corresponds to the corresponding center depth within the material (e.g., the center of the wall) in which at least 50% martensite forms after heat treatment.

One concern of alloying with Manganese (Mn) is that it has a strong effect on reducing the martensite start (Ms) and martensite finish (Mf) temperatures, which could introduce the problem of retained austenite into the microstructure if the temperatures fall too low. The Ms and Mf temperatures for a nominal NiCrMoV composition are predicted to be 552° F. and 165° F., respectively. In comparison the Ms and Mf temperatures for a nominal composition alloy given in Table 1 are estimated to be 497° F. and 110° F., respectively. Consequently, the inventive alloy in Table 1 transforms above room temperature during quenching which will prevent problems related to retained austenite or quench cracking.

The martensitic microstructure has increased material toughness as compared to other alloys, such as NiCrMoV. Increasing the percentage of martensite in the material microstructure will decrease the FATT of the material. Increasing the ideal diameter of a material increases the amount of martensite thus decreasing the FATT of the material in thicker cross sections. A material at a temperature below the FATT will have low fracture toughness and low damage tolerance. To form a damage tolerant component, the operating temperature of the component should be above the FATT.

In one embodiment, a component formed from the composition, according to the present disclosure, includes a FATT at the surface of less than −40° F. (−40° C.) or less than −50° F. (−45.6° C.) or less than −60° F. (−51.1° C.). In addition, the component includes a FATT of less than 86° F. (30° C.) or less than 80° F. (26.7° C.) or less than 75° F. (23.9° C.) at the maximum thickness of the component.

In addition to increasing the ideal diameter (a), properties of the material that decrease FATT include, but are not limited to, increasing martensite percentage, decreasing grain size, decreasing yield strength, or a combination thereof. In one embodiment, a desired yield strength of the material is 650 MPa or greater or about 650 MPa to about 1000 MPa and tensile strength between about 800 and about 1,000 MPa. In a further embodiment, the average grain size of a material is formed during processing of the material, and is maintained to about 62 μm or less or about 50 μm or less. The FATT of the material having a defined yield strength range and grain size range is adjusted through adjustments in microstructure. In one embodiment, the microstructure is adjusted through increases and/or decreases in concentrations of alloying elements. The alloying elements include, but are not limited to, carbon, silicon, manganese, nickel (from 0% to trace amounts), chromium, molybdenum, vanadium, sulfur (optional), phosphorus (optional), copper (optional), or a combination thereof. A trace amount is defined as 0.02% or less, and small trace amounts of nickel are sometimes present in various metals or steels. In addition to adjusting microstructure, increases and/or decreases in the concentrations of the alloying elements adjust material strength, toughness, ductility, grain size, or a combination thereof.

In one embodiment, the manganese concentration and the chromium concentration are increased. A hardenability of a material is affected by the amount of each element present in the material. The hardenability is the ease at which the material forms a martensitic structure during quenching from an austenitizing temperature. Increasing the manganese and chromium concentrations increase a hardenability of the material. Increasing the hardenability of the material increases the ideal diameter, which increases martensitic structure formation and decreases the FATT in thick cross sections, thus providing for increased damage tolerance.

An exemplary process for forming the component includes forging of the component. After forging, the component is heat treated through methods including, but not limited to, austenitizing, quenching, tempering, or a combination thereof. Austenitizing is the process of holding the martensitic alloy forging above a critical temperature for a sufficient period of time to ensure that the matrix is fully transformed to austenite. In order to produce a single-phase matrix microstructure (austenite) with a uniform carbon distribution, austenitizing includes holding the forging at temperatures greater than about 870° C. (1,598° F.) for a time period that is sufficient to fully convert the matrix of the thickest section to austenite. Quenching from the austenitizing temperature forms a martensite microstructure and may be accomplished with any suitable quenching method known in the art. The rate of quench has to be high enough to reduce or eliminate ferrite/pearlite or bainite formation. Tempering is provided to increase the toughness and reduce the brittleness of the component. Suitable tempering temperatures include, but are not limited to, between about 550° C. (1,022° F.) and about 650° C. (1,202° F.), between about 580° C. (1,076° F.) and about 620° C. (1,148° F.), or about 600° C. (1,112° F.), or any combination, sub-combination, range, or sub-range thereof.

EXAMPLES

Comparative Example 1

Comparative Example 1: The known composition of NiCrMoV steel, a material known for use in turbomachine shaft manufacture, is shown below:

| Comparative Ex. 1 - NiCrMoV | |
|---|---|
| | wt % |
| Carbon | 0.29 |
| Silicon | 0.25 |
| Manganese | 0.40 |
| Nickel | 2.80 |
| Chromium | 1.60 |
| Molybdenum | 0.55 |
| Vanadium | 0.11 |
| Iron | Balance |

The nominal composition of Comparative Example 1 corresponds to a hardenability corresponding to an ideal diameter of 14 inches, an estimated martensite start (Ms) temperature of 552° F. and an estimated martensite finish (Mf) temperature of 165° F.

Example 1

Example 1: A martensitic alloy composition having the following composition:

| Example 1 | |
|---|---|
| | wt % |
| Carbon | 0.28 |
| Silicon | 0.25 |
| Manganese | 2.50 |
| Nickel | 0-trace |
| Chromium | 2.00 |
| Molybdenum | 0.50 |
| Vanadium | 0.10 |
| Iron | Balance |

A component, shown as Example 1, is formed from an exemplary composition according to the present disclosure. The nominal composition of Example 1 has an estimated hardenability corresponding to an ideal diameter of 30 inches, an estimated martensite start (Ms) temperature of 497° F. and an estimated martensite finish (Mf) temperature of 110° F.

Example 2

Example 2: A martensitic alloy composition having the following composition:

| Example 2 | |
|---|---|
| | wt % |
| Carbon | 0.28 |
| Silicon | 0.25 |
| Manganese | 2.10 |
| Nickel | 0-trace |
| Chromium | 2.00 |
| Molybdenum | 0.50 |

-continued

| Example 2 | |
|---|---|
| | wt % |
| Vanadium | 0.10 |
| Iron | Balance |

A component, shown as Example 2, is formed from an exemplary composition according to the present disclosure. The nominal composition of Example 2 has an estimated hardenability corresponding to an ideal diameter of 24.7 inches, an estimated martensite start (Ms) temperature of 521° F. and an estimated martensite finish (Mf) temperature of 134° F.

Example 3

Example 3: A martensitic alloy composition having the following composition:

| Example 3 | |
|---|---|
| | wt % |
| Carbon | 0.28 |
| Silicon | 0.25 |
| Manganese | 2.20 |
| Nickel | 0-trace |
| Chromium | 2.00 |
| Molybdenum | 0.50 |
| Vanadium | 0.10 |
| Iron | Balance |

A component, shown as Example 3, is formed from an exemplary composition according to the present disclosure. The nominal composition of Example 3 has an estimated hardenability corresponding to an ideal diameter of 25.8 inches, an estimated martensite start (Ms) temperature of 515° F. and an estimated martensite finish (Mf) temperature of 128° F.

Example 4

Example 4: A martensitic alloy composition having the following composition:

| Example 4 | |
|---|---|
| | wt % |
| Carbon | 0.28 |
| Silicon | 0.25 |
| Manganese | 2.30 |
| Nickel | 0-trace |
| Chromium | 2.00 |
| Molybdenum | 0.50 |
| Vanadium | 0.10 |
| Iron | Balance |

A component, shown as Example 4, is formed from an exemplary composition according to the present disclosure. The nominal composition of Example 4 has an estimated hardenability corresponding to an ideal diameter of 26.9 inches, an estimated martensite start (Ms) temperature of 509° F. and an estimated martensite finish (Mf) temperature of 122° F.

Example 5

Example 5: A martensitic alloy composition having the following composition:

| Example 5 | |
|---|---|
| | wt % |
| Carbon | 0.28 |
| Silicon | 0.25 |
| Manganese | 2.40 |
| Nickel | 0-trace |
| Chromium | 2.00 |
| Molybdenum | 0.50 |
| Vanadium | 0.10 |
| Iron | Balance |

A component, shown as Example 5, is formed from an exemplary composition according to the present disclosure. The nominal composition of Example 5 has an estimated hardenability corresponding to an ideal diameter of 28 inches, an estimated martensite start (Ms) temperature of 503° F. and an estimated martensite finish (Mf) temperature of 116° F.

Example 6

Example 6: A martensitic alloy composition having the following composition:

| Example 6 | |
|---|---|
| | wt % |
| Carbon | 0.28 |
| Silicon | 0.25 |
| Manganese | 2.60 |
| Nickel | 0-trace |
| Chromium | 2.00 |
| Molybdenum | 0.50 |
| Vanadium | 0.10 |
| Iron | Balance |

A component, shown as Example 6, is formed from an exemplary composition according to the present disclosure. The nominal composition of Example 6 has an estimated hardenability corresponding to an ideal diameter of 30.2 inches, an estimated martensite start (Ms) temperature of 491° F. and an estimated martensite finish (Mf) temperature of 104° F.

Example 7

Example 7: A martensitic alloy composition having the following composition:

| Example 7 | |
|---|---|
| | wt % |
| Carbon | 0.28 |
| Silicon | 0.25 |
| Manganese | 2.70 |
| Nickel | 0-trace |
| Chromium | 2.00 |
| Molybdenum | 0.50 |

-continued

| Example 7 | |
|---|---|
| | wt % |
| Vanadium | 0.10 |
| Iron | Balance |

A component, shown as Example 7, is formed from an exemplary composition according to the present disclosure. The nominal composition of Example 7 has an estimated hardenability corresponding to an ideal diameter of 31.3 inches, an estimated martensite start (Ms) temperature of 485° F. and an estimated martensite finish (Mf) temperature of 98° F.

Example 8

Example 8: A martensitic alloy composition having the following composition:

| Example 8 | |
|---|---|
| | wt % |
| Carbon | 0.28 |
| Silicon | 0.25 |
| Manganese | 2.80 |
| Nickel | 0-trace |
| Chromium | 2.00 |
| Molybdenum | 0.50 |
| Vanadium | 0.10 |
| Iron | Balance |

A component, shown as Example 8, is formed from an exemplary composition according to the present disclosure. The nominal composition of Example 8 has an estimated hardenability corresponding to an ideal diameter of 32.3 inches, an estimated martensite start (Ms) temperature of 479° F. and an estimated martensite finish (Mf) temperature of 92° F.

Example 9

Example 9: A martensitic alloy composition having the following composition:

| Example 9 | |
|---|---|
| | wt % |
| Carbon | 0.28 |
| Silicon | 0.25 |
| Manganese | 2.90 |
| Nickel | 0-trace |
| Chromium | 2.00 |
| Molybdenum | 0.50 |
| Vanadium | 0.10 |
| Iron | Balance |

A component, shown as Example 9, is formed from an exemplary composition according to the present disclosure. The nominal composition of Example 9 has an estimated hardenability corresponding to an ideal diameter of 33.4 inches, an estimated martensite start (Ms) temperature of 473° F. and an estimated martensite finish (Mf) temperature of 86° F.

Example 10

Example 10: A martensitic alloy composition having the following composition:

| Example 10 | |
|---|---|
| | wt % |
| Carbon | 0.28 |
| Silicon | 0.25 |
| Manganese | 3.00 |
| Nickel | 0-trace |
| Chromium | 2.00 |
| Molybdenum | 0.50 |
| Vanadium | 0.10 |
| Iron | Balance |

A component, shown as Example 10, is formed from an exemplary composition according to the present disclosure. The nominal composition of Example 10 has an estimated hardenability corresponding to an ideal diameter of 34.5 inches, an estimated martensite start (Ms) temperature of 467° F. and an estimated martensite finish (Mf) temperature of 80° F.

A technical advantage of the manganese-chromium martensitic alloy described herein is that the new material will be able to more readily form a desirable martensitic microstructure in deep-seated locations than NiCrMoV (or similar alloys) by leveraging the potent hardenability effects of manganese and chromium. Nickel has an almost negligible effect on hardenability when compared to both Mn and Cr. This difference can be illustrated by comparing the ideal diameter multiplying factors for 1.0% additions of the three elements. For a 1.0% addition of Ni the multiplying factor is 1.363, for Mn it is 4.333, and for Cr it is 3.160. These FIGURES clearly show that both Mn and Cr have a much greater impact on hardenability than Ni, with Mn having the most potent effect. An additional technical advantage of the manganese-chromium martensitic alloy described herein is that the hardenability was greatly increased without introducing problems related to retained austenite and quench cracking as indicated by the martensite start (Ms) and martensite finish (Mf) temperatures. The Ms and Mf temperatures for the manganese-chromium martensitic alloy are estimated to be 497° F. and 110° F. Consequently, the new alloy will transform during heat treatment above room temperature, which will prevent and/or reduce problems related to retained austenite or quench cracking. A commercial advantage of the manganese-chromium martensitic alloy is that it will be cheaper than NiCrMoV because it will utilize low cost Mn and Cr as the primary alloying elements instead of costlier Ni, and this will drive the net cost of energy equipment and hence energy production down.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A martensitic alloy component, comprising by weight:
0.25% to 0.31% C;
2.1% to 3.0% Mn;
0.22% to 0.28% Si;
2.0% to 2.2% Cr;
0.45% to 0.55% Mo;
0.08% to 0.12% V; and
balance iron and incidental impurities; and
wherein the component is formed without Al, Ni, Ti, and Nb,
wherein the component is formed by austenitizing the alloy at a temperature of great than 870 degrees Celsius converting a thickest section of the alloy to an austenite, followed by quenching to eliminate a ferrite/pearlite or a bainite formation, and followed by tempering between 550 degrees Celsius and 650 degrees Celsius,
wherein the component has a fracture appearance transition temperature at a surface of the component of less than negative forty degrees Celsius and less than thirty degrees Celsius at a maximum thickness of the component, and
wherein the component has a hardenability corresponding to an ideal diameter of about 15 inches to about 30 inches or more.

2. The martensitic alloy component of claim 1, wherein the component comprises 2.2% to 3.0% Mn.

3. The martensitic alloy component of claim 1, wherein the component comprises 2.3% to 3.0% Mn.

4. The martensitic alloy component of claim 1, wherein the component comprises 2.4% to 3.0% Mn.

5. The martensitic alloy component of claim 1, wherein the component comprises 2.5% to 3.0% Mn.

6. The martensitic alloy component of claim 1, wherein the component comprises 2.6% to 3.0% Mn.

7. The martensitic alloy component of claim 1, wherein the component comprises 2.1% to 2.2% Cr.

8. The martensitic alloy component of claim 1, wherein the component has a hardenability corresponding to an ideal diameter of from 20 inches to 30 inches.

9. The martensitic alloy component of claim 1, wherein the component has a hardenability corresponding to an ideal diameter of about 30 inches.

10. The martensitic alloy component of claim 1, wherein the component is a turbomachine rotor shaft.

11. The martensitic alloy component of claim 1, wherein the component is a turbomachine part.

12. The martensitic alloy component of claim 1, wherein the component is a wind turbine part.

13. A turbomachine shaft comprising a martensitic alloy, the martensitic alloy including by weight:
0.25% to 0.31% C;
2.1% to 3.0% Mn;
0.22% to 0.28% Si;
2.0% to 2.2% Cr;
0.45% to 0.55% Mo;
0.08% to 0.12% V;
balance iron and incidental impurities; and
wherein the component is formed without Al, Ni, Ti, and Nb,
wherein the component is formed by austenitizing the alloy at a temperature of great than 870 degrees Celsius converting a thickest section of the alloy to an austenite, followed by quenching to eliminate a ferrite/pearlite or a bainite formation, and followed by tempering between 550 degrees Celsius and 650 degrees Celsius, wherein the component has a fracture appearance transition temperature at a surface of the component of less than negative forty degrees Celsius and less than thirty degrees Celsius at a maximum thickness of the component, and wherein the martensitic alloy has a hardenability corresponding to an ideal diameter of about 20 inches to about 30 inches or more.

14. The turbomachine shaft of claim 13, wherein the martensitic alloy includes 2.2% to 3.0% Mn.

15. The turbomachine shaft of claim 13, wherein the martensitic alloy includes 2.3% to 3.0% Mn.

16. The turbomachine shaft of claim 13, wherein the martensitic alloy includes 2.5% to 3.0% Mn.

17. The turbomachine shaft of claim 13, wherein the martensitic alloy includes 2.6% to 3.0% Mn.

18. A process of forming a martensitic alloy component, the process comprising:

forging an alloy comprising by weight:

0.25% to 0.31% C;

2.1% to 3.0% Mn;

0.22% to 0.28% Si;

2.0% to 2.2% Cr;

0.45% to 0.55% Mo;

0.08% to 0.12% V;

balance iron and incidental impurities; and wherein the component is formed without Al, Ni, Ti, and Nb, wherein the component is formed by austenitizing the alloy at a temperature of great than 870 degrees Celsius converting a thickest section of the alloy to an austenite, followed by quenching to eliminate a ferrite/pearlite or a bainite formation, and followed by tempering between 550 degrees Celsius and 650 degrees Celsius, wherein the component has a fracture appearance transition temperature at a surface of the component of less than negative forty degrees Celsius and less than thirty degrees Celsius at a maximum thickness of the component, and wherein the component has a hardenability corresponding to an ideal diameter of 20 inches to 30 inches or more.

19. The process of claim 18, wherein the component has a thickness of greater than 20 inches.

20. The process of claim 18, wherein the component is turbomachine shaft or a wind turbine shaft.

* * * * *